United States Patent [19]

Nishimura et al.

[11] 4,190,572

[45] Feb. 26, 1980

[54] METHOD OF PRODUCING A LEATHER-LIKE SHEET WITH A DELICATE APPEARANCE AND A DELUXE HAND

[75] Inventors: Takeo Nishimura, Okayama; Mikihiro Matsui, Ibaraki; Tomio Mizuse; Shunji Ishizaki, both of Himeji, all of Japan

[73] Assignee: Kuraray Co., Ltd., Kurashiki City, Japan

[21] Appl. No.: 942,759

[22] Filed: Sep. 15, 1978

Related U.S. Application Data

[63] Continuation-in-part of Ser. No. 805,700, Jun. 13, 1977, abandoned.

[30] Foreign Application Priority Data

Jun. 14, 1976 [JP] Japan ..... 51/70061

[51] Int. Cl.[2] ..... B29D 27/04

[52] U.S. Cl. ..... 264/46.4; 264/41; 264/282; 264/321; 264/340; 427/257

[58] Field of Search ..... 264/321, 282, 46.4, 264/340; 427/257

[56] References Cited

U.S. PATENT DOCUMENTS

| | | | |
|---|---|---|---|
| 3,415,913 | 12/1968 | Lux | 264/321 X |
| 3,429,729 | 2/1969 | McCarthy | 427/336 X |
| 3,667,982 | 6/1972 | Bukalders | 427/257 X |
| 3,689,629 | 9/1972 | Hull | 427/336 X |
| 3,763,301 | 10/1973 | Civardi et al. | 264/321 |
| 3,931,437 | 1/1976 | Civardi et al. | 427/336 X |

*Primary Examiner*—Philip Anderson
*Attorney, Agent, or Firm*—Barry Kramer

[57] ABSTRACT

A method of producing a leather-like sheet having a deluxe feeling is provided comprising preparing and fully curing a leather-like sheet comprising a porous substrate consisting of a porous layer of elastomer and/or a porous layer of fibrous material and a nonporous coating layer of elastomer coated in a thickness of 0.5 to 50 μ on the surface of said porous substrate, crumpling said fully cured sheet in the absence of tension in a liquid medium and, then, drying the crumpled sheet at a temperature not exceeding 100° C. in the absence of tension.

8 Claims, No Drawings

METHOD OF PRODUCING A LEATHER-LIKE SHEET WITH A DELICATE APPEARANCE AND A DELUXE HAND

Cross-Reference to Related Application

This application is a continuation-in-part of copending application Ser. No. 805,700 filed June 13, 1977 now abandoned.

BACKGROUND OF THE INVENTION

1. Field of the Invention

This invention relates to a method of producing a leather-like sheet with a delicate appearance and a deluxe hand. More particularly, the invention relates to a method of producing a leather-like sheet with a deluxe hand which comprises preparing and fully curing a leather-like sheet consisting essentially of a porous substrate layer, made up of a fibrous material and/or an elastomer and a nonporous elastomer layer coated onto said porous substrate layer, subjecting said sheet to a flexing or graining or crumpling treatment under no tension in a liquid medium, drying the same sheet at a low temperature and under no tension, with or without a coloration layer as formed on said sheet. The invention is further directed to the leather-like products obtainable by the above method.

2. Description of the Prior Art

A leather-like sheet consisting of a fibrous material and a polymer material based on an elastomeric polymer is known as synthetic leather, simulated leather or artificial leather, and has been widely employed as a substitute for genuine or natural leather in footwear, carrying bags, clothing and interior materials. Heretofore, such a leather-like sheet has been manufactured by fabricating a porous substrate from a fibrous material and polymeric material based on an elastomer, applying a coloration layer comprising a pigment and a polymeric component to the substrate and embossing the assembly. The conventional leather-like sheet obtained in the above manner has serious disadvantages in comparison with genuine leather. Thus, such sheet is not only inferior to genuine leather in the brightness of color and the delicacy of appearance but also lacks the flexibility and solid feeling of genuine leather. Notwithstanding the advantages of such a leather-like sheet, such as greater resistance to water, greater ease with which it may be cleaned when soiled, greater ease with which it may be fabricated into end-use products at higher yields, and lesser fluctuations in supply, the aforesaid disadvantages have put such artificial sheet at a considerable disadvantage, price-wise, as compared to genuine leather. Thus, while genuine leather is almost exclusively employed in expensive, quality products; artificial leather is employed only in medium- and low-priced products, thus creating a general impression that the footwear, bags, interior materials, etc. made of simulated leather sheet are low-quality products. It is an essential prerequisite, therefore, to overcome the above disadvantages in order that leather-like sheets may attain a status equal to that of genuine leather in the market place.

To accomplish bright shades, it has heretofore been proposed to superimpose a polymeric layer with a satisfactory dye receptivity on a porous substrate, in lieu of providing a coloration layer comprising a pigment and a polymer (hereinafter such a product will sometimes be referred to as pigmented product), and then dyeing the same by a jigger or pad dyeing method. However, despite the obvious improvement of the brightness of shades over the more conventional pigmented products, the leather-like sheets obtained by the above procedures still have serious disadvantages. Thus, for example, it is difficult to attain a delicate appearance and the product has a harsh or stiffened feeling.

To attain a delicate appearance, the practice is to emboss the sheet with a heating calender or roller engraved with the grained pattern of genuine leather or to "grain" the sheet under heating on a sanforizing or equivalent machine, which is widely employed for the shrinkproofing of fabrics.

Methods have been adapted to impart "grain" to the sheet by the application of an external physical force at a high temperature near the softening point of the elastomer employed, thus taking advantage of the thermoplasticity of the material; however, these methods give rise to the formation of regular surface patterns in the sheet. These methods are considered disadvantageous in that the products tend to appear "artificially-made" and, because the elastomer layer is subjected to elevated temperature and pressure during the process, the air-permeability, flexibility and feeling of the products are adversely affected.

There also are known procedures for improving the so-called feel or hand of the sheet through a chemical treatment, with a softening agent, or a mechanical flexing or crumpling procedure. However, in the chemical method, certain softening agents enable the obtainment of the desired softness but the same agents result in the rubber-like hand. Moreover, in use of the leather-like sheet, such softening agents migrate to the surface of the product causing discoloration, color fading and other defects in addition to the comparatively higher cost of production. In the case of the latter mechanical method, the hitherto-proposed procedure is such that a water-impregnated leather-like sheet is crumpled in an air-containing rotary drum, but generally it is not only difficult to accomplish an adequate graining or crumpling effect (soft feeling) but the disadvantage is encountered that it produces unnecessary wrinkles characteristic of mechanical crumpling. Furthermore, mechanical crumpling, as such, could result in reduced strength if carried out to an excessive degree.

Summary of the Invention

It is an object of this invention to provide a leather-like sheet which is soft in appearance and flexible and, yet, has a solid feeling.

It is another object of this invention to provide a brightly colored leather-like sheet which is at least as deluxe in both appearance and feeling as genuine leather.

These as well as other objects are accomplished by the method of this invention, which comprises preparing and fully curing a leather-like sheet consisting essentially of a porous substrate layer, made up of a fibrous material and/or an elastomer, and a nonporous elastomer layer as coated onto said porous substrate layer, subjecting said sheet to a flexing or crumpling treatment in the absence of tension in a liquid medium, drying said sheet at a low temperature and in the absence of tension, with or without a coloration layer formed on said sheet.

It has now been found that a selection of the proper materials and the application of crumpling or flexing and drying procedures under selected conditions to such selected materials gives rise to products which have surface creases exactly like those of genuine leather, and apparent softness and "hand" which are comparable to those of genuine leather, with considerable improvements in "rubber-like" or "paper-like" properties, which are associated with leather-like sheets and which have heretofore been thought impossible to attain, and yet, these benefits have now been obtained without impairing the original strength of the sheet.

This invention is therefore directed to a method of manufacturing a leather-like sheet having a deluxe hand or feeling, which is characterized in that a fully cured leather-like sheet consisting of a porous substrate layer and a nonporous coating layer of elastomer as thick as 0.5 to 50$\mu$ is crumpled in a liquid in the absence of tension and, then, dried at a temperature not exceeding 100° C. in the absence of tension.

The term "porous substrate" as used herein defines a flexible sheet material made up of a porous layer of fibrous material and/or elastomer and containing an almost countless number of continuous micro or macro pores which can be detected under a microscope at a magnification of about 50 times. The interfiber spaces in a nonwoven fabric and the micropores produced by the wet-coagulation of an elastomer are typical of the porosity of the substrate employed according to this invention. It is necessary, for the purposes of this invention, that the percentage of voids in the porous substrate (void ratio) be sufficiently high and, generally, this ratio should not be less than 10 percent. Preferably, the void ratio is 30 to 70 percent.

The high void ratio not only ensures adequate flexure characteristics to the porous substrate but also leads to the formation of appropriate grain-like creases in the nonporous surface layer during the crumpling operation in a liquid, which will hereinafter be described in detail. When the void ratio is in excess of 90 percent, the resultant grains will be undesirably coarse. The effects of the invention are most pronounced with a product consisting of a porous substrate (particularly based on a nonwoven fabric) or having a void ratio of 40 to 80%, particularly, 60 to 80%. And, in the above case, the thickness of the porous layer is not less than 50$\mu$, preferably not less than 100$\mu$. The thickness of the porous substrate is normally within the range of about 0.5 to 3 mm.

The aforesaid fibrous substrate is a sheet-form material based on a fibrous material such as a nonwoven fabric, woven fabric or knitted fabric as impregnated and cured or coagulated with a polymeric binder. The aforesaid fibrous material may be any ordinary kind of fiber, thus including cotton, linen, wool, spun rayon, rayon staple, acetate, nylon, polyester, polyacrylonitrile, vinylon, polyolefin and other fibers, as well as the corresponding mix-spun or composite fibers.

The binder which may optionally be applied to the aforementioned fibrous material may be any of the binding agents that are generally used in the production of simulated leather and other materials. Thus, for example, natural rubber, acrylic resin, styrene-butadiene copolymer, acrylonitrile-butadiene copolymer, polyvinyl chloride, polyurethane and other synthetic rubbers and mixtures of such materials may be mentioned. Such binders are applied in any appropriate form, e.g. as solutions, emulsions and other forms, by such procedures as dipping, coating, spray-coating, etc. The amount of binder so used is normally within the range not exceeding 150 percent based on the fiber.

The elastomer layer applied to at least one side of the fibrous substrate forms a layer corresponding to the so-called grain side of an ordinary genuine leather, being a porous layer obtainable by wet-, dry (primarily by foaming), or semi-dry coagulation methods. The elastomer employed for the stated purpose includes polyurethane, acrylonitrile-butadiene copolymer, etc., although polyurethane elastomers are preferred. The polyurethane elastomers particularly preferred for the purposes of this invention are those elastomers obtainable from a soft segment having a molecular weight of 500 to 4000 such as polyethylene glycol, polytetramethylene glycol, polyhexamethylene glycol, polyethylene adipate glycol, polybutylene adipate glycol, polyhexamethylene adipate glycol, polycaprolactone glycol, etc., a chain extending agent such as ethylene glycol, butanediol, hexanediol, ethanolamine, hydrazine, 4,4'-methylenebis(2-chloroaniline), etc., and a diisocyanate or a mixture of diisocyanates such as diphenylmethane-4,4'-diisocyanate, tolylene diisocyanate, hexamethylene diisocyanate, etc. If necessary, there may be incorporated in said elastomer such additives as a filler, softening agent, stabilizer, antistatic agent, pigment, dyestuff, foaming agent, coagulation-regulator, etc., as well as polymers having good compatibility with said elastomer, such as nitrocellulose, polyvinyl chloride, polyvinyl formal, poly methyl acrylate, vinylidene chloride-acrylonitrile copolymer, etc. The elastomer is applied to the fibrous substrate, preferably by coating or spraying. It is also possible to prepare a self-supporting layer of said elastomer and to laminate it to the fibrous substrate. The porous elastomer layer thus produced, as such, is a porous substrate employable for the purpose of this invention.

By imparting a thin nonporous coating layer to the porous substrate thus produced, there is obtained a leather-like sheet which is fully cured and then subjected to said specific crumpling treatment in a liquid which is a feature of this invention. In accordance with this invention, the selection of the starting material is as important as the conditions of said specific crumpling, which are described hereinafter, for a maximum realization of the effects of this invention. The elastomer layer employed according to this invention is a nonporous coating layer as thick as 0.5 to 50$\mu$ and preferably has a double-layer structure consisting of an over-coating and a dye-receptive layer. For the purpose of preventing color unevenness, i.e., regions of uneven coagulation which are liable to form due to unevenness of the air or bath flow, temperature and other causes in the course of coagulation of the elastomer solution, the over-coating layer is generally formed as a very thin layer, 0.5 to 10$\mu$, of the elastomer containing 10 to 300 weight percent of a pigment based on the polymer, on the surface of the elastomer layer, constituting the porous substrate. Where the regions of uneven coagulation will not be conspicuous in the final product, said over-coating layer may be dispensed with, but it is essential for the unmistakable development of creases resembling those of genuine leather (a certain finely embossed pattern) by the specific crumpling and final drying according to this invention. With a pigment in amounts less than 10 weight percent, it is difficult to cover up the regions of uneven coagulation fully, while when the pigment is used in a proportion exceeding 300 weight percent, no adequate bond with the porous substrate is obtained, nor is it possible to realize a uniform pattern of creases even by the specific crumpling according to this invention. The regions of uneven coagulation cannot be fully covered up when the coating amount (thickness) of said polymer is less than 0.5μ while where the thickness is in excess of 10μ, not only do deteriorations take place in crease and grain characteristics, feeling and flexure fatigue but other disadvantages result as well. Thus, when the coating amount of the polymer exceeds the above range, it is not only difficult to establish the conditions of specific treatment within a preferred range but the entire balance between the dye-receptive layer and porous substrate is disturbed to interfere with the development of well-defined creases (similar to embossed patterns) resembling those of genuine leather which, in accordance with this invention, are obtainable without embossing.

In accordance with this invention, a dye-receptive (easily dyeable) layer is superimposed on said over-coating layer, the thickness of said dye-receptive layer being from 0.5 to 10μ. The dye-receptive layer is employed so that the final product will be attractively dyed (colored), but the thickness of such a layer is dictated by conditions favorable not only to the development of a brilliant color but also to the development of satisfactory bending strength, crease and grain characteristics, as well as the soft feeling and crease characteristics resembling that of genuine leather which are major characteristics of the invention.

In accordance with this invention, there may also be disposed a nonporous intermediate layer, in addition to said over-coating and dye-receptive layers, either beneath said over-coating layer or between said over-coating and dye-receptive layers. However, if such elastic nonporous layer gains so much in thickness, the creases obtainable by the liquid crumpling (flexing) treatment of this invention will be undesirably coarse and harsh. Therefore, the thickness of such a nonporous top-layer structure inclusive of said over-coating and dye-receptive layers should not exceed 50μ. Generally, the thickness of such nonporous elastomer coating layer should be selected from within the range of 0.5 to 20μ and in consideration of the balance between it and the porous substrate and where the porous substrate itself is one consisting of a fibrous base material and, as disposed thereon, a porous elastomer layer, the thickness of said nonporous layer is most desirably selected from within the range of 1 to 10μ.

The polymer to be used for the formation of such a nonporous elastomer layer may be the elastomer employed in the formation of the aforesaid porous elastomer layer superimposed on the porous substrate, and is preferably a polyurethane elastomer. Where it is used for the formation of said over-coating layer or said intermediate or under layer, said polyurethane elastomer may be of almost any kind. However, in order to accomplish an effective development of a brilliant shade and of desirable grain-like creases, the dye-receptive layer is most preferably made from polymers which are predominantly made up of polyurethane elastomers in which polyethylene glycol constitutes a component of its soft segment.

In particular, normally the ratio of said polyethylene glycol to the total soft segment and the ratio of the polyurethane elastomer containing said polyethylene glycol in its soft segment to the total elastomeric polymer are preferably in such proportions that their product will be equal to at least 0.02.

$$\text{Product} = \frac{\text{Total weight of polyethylene glycol}}{\text{Total weight of soft segment}} \times \frac{\text{Total weight of polyurethane containing polyethylene glycol in soft segment}}{\text{Total weight of polymer}} \geqq 0.02$$

It is not certain why, when a polyurethane containing polyethylene glycol in its soft segment is employed as the dye-receptive layer (to be disposed as substantially the uppermost layer of the leather-like sheet), the surface has an exceedingly soft feeling. However, it is presumably because this polyurethane has an extraordinary affinity for the water medium employed in the course of the liquid crumpling treatment.

When selecting a polyurethane for the formation of said dye-receptive layer, the nitrogen content, based on the diisocyanate component, of such polyurethane elastomer also has an influence upon the dyeability of the dye-receptive layer as well as upon such characteristics as flexure fatigue, crease, bending crimp and grain characteristics, etc., and is preferably within the range of 3 to 7 weight percent.

It is desirable that in this dye-receptive layer, a dyestuff be previously incorporated in an amount up to 150 weight percent. The dye used in the dye-receptive layer may be any dyestuff soluble in the solvent for said polyurethane elastomer but where it is necessary that the dye remain in the final product, a metal complex salt dye is optimum in view of the light fastness, resistance to migration, etc., which it provides and where such a dye is required only for covering up flaws in the application of the dye-receptive layer but must be removed before the dyeing step, it is most desirable to employ a dye which has no affinity (dyeing affinity) for the polyurethane elastomer and is soluble in water, for example, one of certain acid dyestuffs. Furthermore, to preclude the formation of regions of color unevenness which are liable to be produced in the dyeing step, it is possible to apply a small amount of a polyurethane elastomer-based polymeric material which, as such, has few dyeing sites and is poorly dyeable on top of said dye-receptive layer.

As to the procedure of applying thin elastomer layers (over-coating and dye-receptive layers) to the surface of said porous substrate, the elastomeric polymer may be applied by the gravure printing method or by spray-coating and evaporating the solvent from the coat. Therefore, the layers are generally nonporous. Moreover, the leather-like sheet obtained in the above manner may be embossed as desired, either before or after the liquid crumpling treatment.

The porous sheet obtained in the above manner is fully cured and then submerged in a liquid and, under intense stirring but under no tension, subjected to a random flexing (liquid crumpling) treatment.

If a tension force is applied to the porous sheet or the sheet is held stationary, not only will the product have an inferior hand but the desired creases will not be produced, thus failing to give a soft appearance.

In the present invention, it is essential that the medium used for the crumpling operation be a liquid. The high resistance of the liquid contributes to a greater crumpling effect under no tension. The pronounced crumpling effect of this invention cannot be realized when the medium is a gas such as air even assuming that identical equipment is employed. The most effective medium for the purposes of this invention is water, although other liquids such as alcohols (methanol, ethanol, etc.) and inert lower hydrocarbons, as well as mixtures of such liquids, may also be employed. When an organic solvent is employed as the crumpling medium, it must be inert to the constituents of the leather-like sheet. If desired, a dye, softening agent and/or other additives may be incorporated in the liquid medium. When a dye has been added, the drying effect is accomplished concurrently with the accomplishment of the graining effect of this invention and, therefore, the entire production process is simplified. When a softening agent or other additive is employed, care should be exercised in the selection of such additive agent, for certain additives could adversely affect the effect of this invention (e.g., soft feeling). Among preferred softening agents are sorbitan ester activators, low molecular polyoxyalkylene alkyl esters and turkey red oil. The liquid medium containing such additives may be a solution, an emulsion or any other appropriate medium. The crumpling operation is conducted in an apparatus which may, for example, be an apparatus resembling a laundering machine equipped with a revolving screw member within a tank, a device adapted so that a liquid is compressed by a pump and forced into a tank to generate a vortex of liquid jets, or a bowl or drum-type apparatus equipped with a baffle member on its internal wall for improved agitation of liquid and adapted so that the bowl or drum as a whole or an inner member thereof may freely revolve. It is most desirable to employ an apparatus such that its tank as a whole or an inner member thereof is rotatable in a vertical plane so that the material to be processed may fall only under its own weight to create a random flexing action, for no external force will then be acting upon the material which will thus be flexed under a minimum of tension.

The substrate sheet may be in any shape as it is subjected to the crumpling operation of this invention, although an excessively large sheet will prove undesirable for the purposes of this invention. For example, when the sheet is more than 20 m long, the use of said apparatus resembling a laundering machine would create an uneven tension within the sheet and insufficient flexing action would be obtained. This invention is generally applied to sheets not exceeding 10 m in length, normally to sheets within the range of 0.5 to 5 meters.

The operating temperature of said liquid medium is preferably within the range of 20° to 70° C. in consideration of the magnitude of each flexure crease.

The dye to be used in conjunction with the practice of this invention is most desirably a metal complex salt dye in view of its high light fastness and migration resistance, among others. The softening agent is desirably a substance which has a maximum of softening action and a minimum of decolorizing action.

Normally, prior to dyeing, premoisturizing is carried out to prevent uneven dyeing or remove the dye used for covering up flaws in the application of said dye-receptive layer. The temperature of the premoisturizing water also is preferably 20° to 70° C. as is the case with the aforesaid dyeing and softening treatment.

The porous sheet which has undergone the dyeing and/or softening treatment described above is finally subjected to a low-temperature drying operation in the absence of tension which is another feature of this invention. The selection of the proper drying temperature and tension is essential to the objects of this invention. The drying of a conventional wet sheet is performed in a hot air current within the temperature range of about 140° to 150° C. for commercial purposes and by means of a pin tentering machine (which normally gives a tension of about 0.5 to 2 kg per linear inch per 1.5 mm thickness) or the like for shape-retention purposes. However, in accordance with this invention, the drying is effected at a temperature not exceeding 100° C., preferably within the range of 10° to 70° C. and in the substantial absence of tension, i.e., less than 0.3 kg or, preferably 0.1 kg to substantially zero per 1.5 mm thickness per inch width. If the drying temperature is higher than the above range or an excessive tension is applied, the feeling and apparent softness are sacrificed and no neat flexure creases can be obtained.

The leather-like sheet thus obtained is finished by the conventional finishing techniques available and used for leather-like sheets wherein the effects of this invention will not be adversely affected. Especially, in many instances, a coloration layer composed of a polymer and a colorant is applied to the sheet. The polymer used for this purpose may be a polyurethane elastomer similar to that mentioned in connection with said porous substrate layer or a polymer compatible with said elastomer. As in the case of dyeing, the dyestuff is most desirably a metal complex salt dye.

The leather-like sheet obtained in the described manner has fine flexure creases which give rise to an apparent softness as well as a deluxe feeling due to its excellent hand and bright shade. The invention will be further described by way of the following examples in which all percentages are by weight.

EXAMPLE 1

A nonwoven polyester web, 150 cm wide, was impregnated with a solution comprising 15% of a polyurethane elastomer (nitrogen content 4%) of polyethylene adipate glycol, ethylene glycol and diphenylmethane-4,4'-diisocyanate, 1% of brown pigment, 2% of water and 82% of dimethylformamide. Then the same solution as above was further layered onto the web at a rate of 100 g/m$^2$ on a solids basis. The web was immersed in a coagulation bath of 30% dimethylformamide and 70% water at 35° C. for 30 minutes, after which time the web was treated to remove the solvent and dried to obtain a porous substrate. The thickness of the surface coat was about 300$\mu$, with the void ratio being 70%. In view of the fairly extensive regions of uneven coagulation on this porous substrate, the surface was covered up by overcoating with a solution of 5% of the same polyurethane elastomer as above, 7% of brown pigment, 22% of dimethylformamide and 66% of methyl ethyl ketone (over-coating layer, 1.5 g solids/m$^2$), thereby hiding the regions of uneven coagulation. Thereafter, the substrate was further coated, on top of said over-coating layer, with a solution comprising 7% of a polyurethane elastomer (nitrogen content 5.5%) of polyethylene glycol, ethylene glycol and diphenylmethane-4,4'-diisocyanate, 1% of Kayanol Milling Brown 4 GW (an acid dyestuff available from Nihon Kayaku K.K.), 21% of dimethylformamide and 71% of methyl ethyl ketone at a rate of 2.5 g solids/m$^2$ (dye-receptive layer). The surface was then embossed to a coarse-weave design and cut to 1 m lengths. Thereafter, the product was premoisturized (decolorized) in an apparatus comprising a drum-shaped tank equipped with baffle-plates on its internal wall and adapted to revolve (12 revolutions per min.) in the vertical direction using warm water at 50° C. for 30 minutes, followed by dyeing under the conditions mentioned below for 30 minutes. The product was further treated with an aqueous dispersion containing 1.5% of polypropylene glycol adipate ester of 40° C. for 10 minutes. Throughout the above operations, the porous sheet was allowed to move and to flex freely within the vessel under no external tension force. After the liquid content of the sheet was adjusted to 130%, the sheet was left standing at room temperaure to dry under no tension.

| | |
|---|---|
| Yellow brown metal complex dye compounding of Lanyl Brown 3R and Lanyl Yellow G (Sumitomo Kogyo K.K.) | 3% owf |
| Bath ratio | 1:50 |
| Bath temperature | 60° C. |

Finally, the sheet was coated with a solution containing 7% of a polyurethane elastomer (nitrogen content 5.5%) of polyethylene glycol, polybutylene adipate glycol (2/1), 1,4-butanediol and diphenylmethane-4,4'-diisocyanate, 3% of brown metal complex dye [Lanyl Brown 3R (Sumitomo Kogyo K.K.)], 21% of dimethylformamide and 69% of methyl ethyl ketone at a rate of 1 g solids per $m^2$ (coloration layer) to produce a leather-like sheet product (A). This leather-like sheet (A) had an apparent softness due to the presence of tiny flexure creases similar to those of genuine leather, a bright shade and an exquisite hand, thus being of high commercial value.

The production conditions of the above leather-like sheet (A) were partially modified to manufacture control sheets (B) through (F). The conditions used and the results obtained are summarized in Table 1. As a test of flexibility, the Gurley stiffness of each sheet was determined according to JIS-L-1079-1976. As to the brightness of shade, apparent softness and hand of each sample sheet, a panel of judges, who were engaged in the development or sale of simulated leather was requested to score the samples and an average of the scores for each evaluation item was recorded on a five-point scale.

shade, this sample (B) was also inferior in hand and other features, being completely identical with the prior art product. The leather-like sheet (C) produced by the mechanical flexing of the leather-like sheet (B) had a slightly improved flexibility but had no adequate flexure creases. In addition, this sheet (C) was somewhat inferior even to (B) in the brightness of shade.

Leather-like sheet (D)

A control test was also carried out to evaluate the influence of tension during the drying process. A leather-like sheet (D) was manufactured in the same manner as above except that, instead of drying in the air, the tenter dryer (which exerted a tension of about 2 kg per inch width and 1.5 mm thickness) was employed. The sheet (D) had a sufficient brightness of shade but substantially no flexure creases. Thus, the sheet had no soft appearance and lacked overal flexibility.

Leather-like sheet (E)

This control test was performed to evaluate the influence of the temperature employed in the drying process.

A leather-like sheet (E) was manufactured under the same conditions, except that the drying operation was carried out at 150° C. in lieu of room temperature. This sheet (E) had no fine creases such as those found in sheet (A), thus having a stiff hand.

Leather-like sheet (F)

This control test was carried out to evaluate the relative advantage of a liquid and a gas as the flexing medium. A cut substrate web was immersed in an aqueous dispersion containing 1.5% of polypropylene glycol adipate ester at 40° C. for 10 minutes, adjusted to a liquid content of 130% and subjected to random flexing in a dye-free empty drum for 40 minutes. Thereafter, the web was treated in the same manner as the sheet (A) to manufacture a leather-like sheet (F).

Although this sheet (F), of course, had no bright shade because it had not been dyed, no adequate flexure effects and, hence, no flexibility could be obtained.

| | Leather-like sheet | Brightness of shade | Apparent softness | Hand | Stiffness (Gurley, mg.) | Overall score |
|---|---|---|---|---|---|---|
| A | | 5 | 5 | 5 | 2600 | 5 |
| B | Jigger | 5 | 1 | 1 | 5200 | 1 |
| C | Jigger & mechanical flexing | 4 | 2 | 2 | 4600 | 2 |
| D | Tenter drying | 5 | 3 | 2–3 | 4800 | 2 |
| E | 150° C. | 5 | 3 | 2 | 5000 | 2 |
| F | Air | 1 | 3 | 3 | 3800 | 3* |

*This evaluation was made in disregard of the brightness of shade.

The relative marketability or commercial value of those leather sheets was also recorded on a 5-point scale. The larger values represented higher quality evaluations.

Leather-like sheets (B) & (C)

A control test was performed for evaluating the effects of tension and flexure during the liquid-flexing crumpling treatment.

A jigger-type machine was used in lieu of the drum machine to manufacture a leather-like sheet (B). This sheet, in turn, was crumpled by means of a conventional mechanical crumpling apparatus as disclosed in U.S. Pat. No. 3,695,801 to manufacture a leather-like sheet (C). Since not only the jigger machine applied a tension to the porous sheet but the movement of the sheet was considerably restricted, no crumpling effect could be obtained in the leather sheet (B). Despite its bright

EXAMPLE 2

A polyethylene sheet embossed to a woolen pattern was coated with a solution consisting of 9% of a polyurethane elastomer composed of polycaprolactone glycol, ethanolamine and diphenylmethane-4,4'-diisocyanate (nitrogen content based on diisocyanate:4.2%), 1.5% of polyvinyl chloride, 1.5% of titanium dioxide and 88% of dimethylacetamide at a rate of 60 g of solids per $m^2$ and the resultant coating layer was immersed in a coagulation bath of 40% dimethylacetamide-60% $H_2O$ at 40° C. Thereafter, the sheet was treated to remove the solvent and dried to obtain a porous film having a thickness of about 200μ. This sheet was bonded to a 1 m-wide woven polyester fabric wrapped on one side to manufacture a porous substrate. In view of some evidence of uneven coagulation on this porous substrate, the surface of the substrate was coated with a solution consisting of 6% of a polyurethane elastomer of the same type as above, 12% of titanium dioxide, 20% of dimethylacetamide, 32% of tetrahydrofuran and 30% of cyclohexanone at a rate of 2 g solids per $m^2$ (about 2μ thick). Then, the surface was further coated with a solution consisting of 7% of the same polyurethane elastomer as that used in Example 1 for the formation of the colored layer of leather-like sheet A, 22% of dimethylacetamide, 41% of tetrahydrofuran and 30% of cyclohexanone at a rate of 3 g solids per $m^2$ (about 3μ thick). The sheet was cut into 1 m lengths, which were dyed in a launderer-type apparatus provided with an internal revolving screw using the following conditions and under no tension so that each porous sheet would be completely free to move. The sheet was then dried at 30° C. to obtain a leather-like sheet (G).

| | |
|---|---|
| Yellow metal complex salt dye Lanyl Yellow G (Sumitomo Kogyo K.K.) | 1.5% owf |
| Bath ratio | 1:100 |
| Bath temperature and dyeing time | 70° C. 20 mins. |

This product had not only a bright shade but also delicate flexure creases completely identical with those of genuine leather on the surface. Thus, having an excellent hand and an apparent softness, this sheet gave the impression of being a deluxe product. As controls, an imitation leather produced by coating a 100μ-thick nonporous layer of polyvinyl chloride on a woven polyester fabric and another imitation leather produced by coating a 100μ-thick nonporous layer of nylon on a similar fabric were each subjected to the same treatments as described in Example 2. The resultant leather-like sheets (H and I) had surface creases which, however, were by far coarser than the creases of leather-like sheet (G), and were inferior to (G) in overall soft feeling as well. The leather-like sheet (H) had not been dyed and had a poor appearance.

EXAMPLE 3

A porous substrate similar to that used in Example 2 was coated with a solution consisting of 2.5% of a polyurethane elastomer of the same type as that used in Example 1 for the formation of the dye-receptive layer of leather-like sheet (A), 5% of a polyurethane elastomer of the same type as that used in Example 1 for the formation of the substrate layer, 4.5% of Lanyl Brown 3R (a metal complex salt dye available from Sumitomo Kagaku Kogyo K.K.), 25% of dimethylformamide, 33% of tetrahydrofuran and 30% of cyclohexanone at a rate of 4.2 g of solids per $m^2$. Thus, upon drying, there was produced a nonporous coating film having a thickness of about 4.2μ. The surface of the sheet was then embossed to a kid-leather design. Using a drum-shaped apparatus similar to that used in Example 1, the sheet was treated with an aqueous solution containing 2% of Turkey red oil at 50° C. for 30 minutes. Then, the sheet was dried at 50° C. and under no tension to obtain a leather-like sheet (J). This sheet was also satisfactory with respect to the brightness of shade, hand and apparent softness, having an overall deluxe feeling. The above procedure was repeated except that the thickness of said nonporous coat was altered to obtain leather-like sheets (K) and (L). It was found that as the thickness of the nonporous layer was increased, both the surface crease pattern and hand of the product were adversely affected. The results evaluated by the same scoring procedure as described in Example 1 are given below in Table 2.

Table 2

| Leather-like sheet | Thickness of nonporous layer (μ) | Brightness of shade | Apparent softness | Hand | Gurley Stiffness (mg) | Overall score |
|---|---|---|---|---|---|---|
| (J) | 4.2 | 5 | 4 | 5 | 2700 | 4 |
| (K) | 14 | 5 | 4 | 4 | 2800 | 4 |
| (L) | 91 | 5 | 2 | 3 | 3100 | 2–3 |

EXAMPLE 4

A leather-like sheet (M) was produced from the uncured sheet material, and a leather-like sheet (N) was produced from the fully cured sheet material.

Leather-like Sheet (M)

A leather-like sheet (M) was produced by proceeding in the same manner as in Example 3 (leather-like sheet (J)) except that the coating layer was neither dried nor embossed. During the tumbling step in the liquid medium, portions of the coating layer of the sheet adhered to each other in places, and it was difficult to keep the coating layer from adhering. The adherent portions of the sheet were peeled off, but the peeled surface of the sheet was terribly rough. In addition, the sheet had an uneven surface, hard feeling and no bright shade which gave the impression of its being an inexpensive or cheap article.

Leather-like Sheet (N)

A leather-like sheet (N) was produced by proceeding in the same manner as in Example 3 (leather-like sheet (J)) except that the embossing step was not carried out. During the tumbling step, adhesion of portions of the coating layer as the leather-like sheet (M) did not occur. The resulting sheet exhibited satisfactory brightness of shade, flat surface and soft feeling. The sheet exhibited an overall deluxe feeling.

What is claimed:

1. A method of producing a leather-like sheet having a deluxe feeling comprising producing a fully cured leather-like sheet comprising a porous substrate consisting of a porous layer of elastomer and a porous layer of fibrous material and a nonporous coating layer of elastomer coated in a thickness of 0.5 to 50μ on the surface of said porous substrate, crumpling said fully cured sheet in the substantial absence of tension in a liquid medium which is inert to the constituents of the leather like sheet and, then drying said crumpled sheet at a temperature not exceeding 100° C. in the substantial absence of tension.

2. A method according to claim 1 wherein said porous layer of elastomer is applied to the fibrous material constituting said porous substrate.

3. A method according to claim 1 wherein the polymer forming said porous layer of elastomer and the polymer forming said nonporous coating layer of elastomer are formed from a polyurethane elastomer.

4. A method according to claim 2 wherein the nonporous coating layer of elastomer consists of an over-coating layer having a thickness of 0.5 to 10μ and containing a pigment in an amount of 10 to 300 weight percent based on said elastomer and a dye-receptive layer having a thickness of 0.5 to 10μ and containing a dye in an amount not exceeding 150 weight percent based on the elastomer.

5. A method according to claim 4 wherein the elastomer forming the dye-receptive layer is a polyurethane elastomer containing polyethylene glycol in its soft segment.

6. A method according to claim 4 wherein the elastomer forming said dye-receptive layer is a polyurethane elastomer containing polyethylene glycol in its soft segment and the product of the weight ratio of said polyurethane elastomer to the total elastomer containing said polyethylene glycol in its soft segment is not less than 0.02.

7. A method according to claim 2 wherein said porous substrate consists of a fibrous substrate material comprising a nonwoven fabric and an elastomer and a porous layer coated on said substrate material, said porous layer comprising from 40 to 80 volume percent of voids.

8. A method according to claim 7 wherein the polymer forming said porous layer of elastomer and the polymer forming said nonporous coating layer of elastomer are formed from a polyurethane elastomer.

* * * * *